US009016026B2

(12) United States Patent
Paulson

(10) Patent No.: US 9,016,026 B2
(45) Date of Patent: Apr. 28, 2015

(54) METHOD AND SYSTEM FOR FORMING FRAMELESS BUILDINGS

(71) Applicant: Wallace S. Paulson, Corona Del Mar, CA (US)

(72) Inventor: Wallace S. Paulson, Corona Del Mar, CA (US)

( * ) Notice: Subject to any disclaimer, the term of this patent is extended or adjusted under 35 U.S.C. 154(b) by 0 days.

(21) Appl. No.: 14/340,334

(22) Filed: Jul. 24, 2014

(65) Prior Publication Data

US 2014/0331597 A1 Nov. 13, 2014

Related U.S. Application Data

(63) Continuation-in-part of application No. 14/088,019, filed on Nov. 22, 2013, now abandoned.

(60) Provisional application No. 61/737,431, filed on Dec. 14, 2012.

(51) Int. Cl.
*E04C 2/32* (2006.01)
*E04B 1/24* (2006.01)

(52) U.S. Cl.
CPC ..... *E04C 2/32* (2013.01); *E04B 1/2403* (2013.01)

(58) Field of Classification Search
CPC ..... E04C 2/32; E04B 1/2403; E04B 1/08; E04B 7/20; E04D 3/30
USPC ..... 428/167, 174, 182; 14/73.1; 411/337–338, 379, 451.2–451.5, 411/455–456, 487, 500, 505; 52/450, 521, 52/527, 630–631, 636, 639, 646, 648.1, 52/656.1
See application file for complete search history.

(56) References Cited

U.S. PATENT DOCUMENTS

| | | | |
|---|---|---|---|
| 2,742,114 | A | 4/1956 | Behlen |
| 3,308,596 | A | 3/1967 | Cooper et al. |
| 3,820,295 | A | 6/1974 | Folley |
| 5,337,592 | A | 8/1994 | Paulson |
| 5,489,463 | A | 2/1996 | Paulson |

(Continued)

OTHER PUBLICATIONS

Office Action from USPTO dated Mar. 7, 2014 for U.S. Appl. No. 14/088,019.

(Continued)

*Primary Examiner* — Jeanette E Chapman
(74) *Attorney, Agent, or Firm* — Klein, O'Neill & Singh, LLP

(57) ABSTRACT

The present invention provides a method of assembling frameless metal buildings by means of securing together a selected number of roll formed corrugated sheets by the use of cyclically bent corner members roll formed to identically match the roll formed sheets and holding the secured together sheets and bent corner members by mechanical fastening means to provide Total Load Connectivity. The formed frameless buildings have mechanical fasteners connecting adjoining similar corrugated panels to form joints with an engineered joint design that will transfer, without internal load redistribution, loads $F_x$, $F_y$, $F_z$, $M_x$, $M_y$ and $M_z$ across the formed joints in the subassemblies and any final on-site assembly so that any desired shaped building may be formed, limited only by the strength of the assembled components and the fastening elements.

17 Claims, 8 Drawing Sheets

(56) References Cited

U.S. PATENT DOCUMENTS 8,024,980 B2 * 9/2011 Arms et al. ..... 73/763
8,573,012 B1 11/2013 Paulson

OTHER PUBLICATIONS

Final Office Action from USPTO dated Jun. 12, 2014 for U.S. Appl. No. 14/088,019.

* cited by examiner

METHOD AND SYSTEM FOR FORMING FRAMELESS BUILDINGS

CROSS-REFERENCE TO RELATED APPLICATIONS

This application claims priority of pending U.S. application Ser. No. 14/088,019, filed on Nov. 22, 2013 which claimed the priority of U.S. Provisional Application No. 61/737,43, filed Dec. 14, 2012, the entire disclosures of which are incorporated in their entirety herein, by this reference thereto.

FIELD OF THE INVENTION

This invention relates generally to building construction, and more specifically to a method for the construction of low-rise frameless metal buildings using high strength corrugated panels, joined together at their junctions by using a new cyclically repetitive joining member. These joints use mechanical (non-welded) connections designed by engineering analysis to create a total load connection where like panels meet, as at a corner.

Changes in building construction have taken place over the years due to changes in technologies. For example, timber structures quickly changed from framed, post and beam construction to simpler, frameless timber construction (i.e., balloon framing), as that technology was invented in the mid-19th century. Balloon framing is still the common wood framing method used for buildings. Today, most low-rise metal buildings, such as commercial and residential buildings, require a framework of metal posts and beams to allow stiffened metal (corrugated) panels to be attached to them. A sub-set of one-story corrugated metal buildings claim frameless construction attributes. They typically have corrugated wall/roof attachments that do not deliver total load connections, and thus do not deliver building strength achievable with using matching cyclically variable connecting members with engineered joint fastener designs that deliver total load connectivity, such as disclosed herein.

In the mid 1800's, an Englishman invented the corrugated metal panel, which he used for roofing on a building. His concept caught attention, and it was widely copied. It developed global attention over the years, and saw many applications. Eventually, complete low-rise metal buildings were being built using corrugated panels for walls, floors and roofs attached to a frame of columns and beams. However, one design issue was never realized, that of properly joining two corrugated panels meeting at a corner to provide a complete structural connection. The metal building industry, unable to design such a connection, accepted that deficiency and thrived in an expanding business, even though its connections were far short of achieving complete structural load connectivity. Therefore, today, world-wide, the low rise metal building industry is booming, using the following three-step design concept: 1. A basic framed structure of columns and beams; 2. high-strength corrugated panels span the many open bays; and 3. panel junction areas use non-structural closures, covers and seals. Even though such low-rise metal building business is booming, total load connections at the corners are not achieved.

In the 1950's an American shipping industry leader, Mr. Malcom McLean, saw the need for a revolutionary change in the world-wide shipping industry. He created a new, revolutionary shipping concept using Intermodal Shipping Containers. Large shipping boxes were designed to create the maximum size shipping box transportable throughout the world by ship, train and truck, within the existing transportation infrastructure. The maximum size for shipping was determined to be approximately 8-ft. wide, 8-ft. high and 40-ft. long. These nominal dimensions are still in use today, with only minor deviations. The walls of the shipping boxes were made of steel corrugated panels, joined at their junctures by continuous welding, to create a tight, leak-proof box for shipping contents of every description, from producer to user, throughout the world. Welding also required that the boxes be fabricated in a factory environment, where the massive welding and weld inspections could be carefully performed.

In the many decades of use as shipping boxes, they have developed a reputation of being strong, sturdy boxes. The reason for this strength is the total load connection at the welded junctions of the box corners. In this connection, all internal loads in a structural member can be summarized by six load types, three orthogonal force vectors $F_x$, $F_y$, and $F_z$, and three orthogonal bending moment vectors $M_x$, $M_y$ and $M_z$. These six force vectors are distributed through the member cross section, defined by known structural analysis methods. A Total Load Connection ("TLC") is achieved when each element of a structure transfers its internal loads directly to its interfacing structural element, with no internal load redistribution. Today's only known corrugated panel TLC is achieved by welding.

By now, many millions of these shipping boxes exist, transporting the world's products. As with all hardware, many used boxes are retired yearly. Companies through the world look for ways to utilize all these many retired boxes. Countless new uses have been found for these retired boxes. The supply is great, and new applications continue to be found. Around the turn of the millennium (2000), one application started receiving a lot of attention—using stacked boxes for low-rise buildings. Multi-story buildings exist today, rising as high as seven floors of stacked, side-by-side boxes. They are used as apartment buildings, schools, offices, factories and warehouses.

However, the use of retired shipping boxes for buildings is complicated by existing design realities imposed by hardware originally designed for other purposes. Refurbishing each retired box to repair, clean up and modify for its next life will be specific for each retired box used, requiring individual real time modification designs. Other realities of using existing structures for new applications include evaluating and finding an acceptable solution for several issues; for example: the standard 8-ft. width of boxes is too narrow for many uses; some means must be used to accommodate the many gaps between adjacent box walls, floors and ceilings; the boxes must be integrated together to meet a building's design requirements; and each modified box must be individually shipped by truck to a building site.

Today's uses of retired shipping boxes for low-rise buildings reveal much to the careful observer. Low-rise buildings of stacked boxes require no external support frame, as opposed to the low-rise metal buildings made from corrugated sheets, which continues to require such framing. This shows that corrugated panels themselves can deliver the total structural potential they inherently have, but have never been able to deliver without TLC at their interfaces with other members.

The use of mechanical fasteners at joints, instead of welds, makes it now possible to assemble any chosen frameless building size and design at its destination site. The designer can maximize in-factory building sub-assembly component sizes so they can be efficiently transported to the building site, using the size and weight constraints imposed by today's transportation infrastructure (8' by 8' by 40' volume, and 80,000 lb weight). Efficient final sub-assembly of the components into the complete low-rise frameless building, using mechanical attachments, can now be achieved on site. Major cost and schedule benefits will arise from this frameless building concept.

BACKGROUND OF THE INVENTION

Sheet metal corrugated members or panels are an essential component used to form low-rise metal buildings. An endless variety of low-rise metal buildings exist throughout the world. In today's metal buildings, corrugated panels are placed over basic frameworks of posts and beams. The corrugated panels are connected together at their meeting points by the use of non-structural closures, covers and seals to allow the buildings to serve a useful function. Attempts to weld corrugated members together at their meeting points in buildings does not work because the thin gage, high strength panels suffer a great loss of strength when heated and the extreme heat of welding causes serious deformations in the thin sheet stock. Welding such panel junctures is not amenable to these buildings because such extensive welding and inspection at a building site have not been deemed feasible. Further, the extreme heat of welding greatly reduces the strength and causes serious deformation of thin panels used in metal buildings. Furthermore, if other materials, such as a high strength plastic, or the like are used in constructing such buildings, welding is also not feasible.

When two similar structural members meet at a juncture, the ideal connection should allow the total internal forces in each element to be transferred to its adjoining member element without redistribution of the internal stresses in the member. As described above, this transfer may be referred to as Total Load Connectivity or TLC. When metal corrugated panels meet at a juncture, currently no method exists to achieve TLC joints other than welding. Welding of corrugated panels in low-rise metal building has been found not to be feasible, as discussed above. The low-rise metal building industry has found ways to work around the concept of TLC at the joints by the use of an initial framework of columns and beams, thus having accepted far less than ideal TLC connections. Yet countless useful buildings exist throughout the world.

Thus, there exists a need in the art for an improved method and system for forming buildings, made from corrugated metal, plastic or other available materials, which are frameless, but which have TLC joints for improved strength that allows them to be either pre-formed in selected configurations and shipped to a site for easy assembly; and/or easily assembled on-site by use of specifically formed cyclically repetitive edge members that exactly conform to the shape of the corrugated panels being used. Additionally, one important consideration that also has to be taken into account has to do with shipment size. To avoid complex shipping constraints, a preferred concept will limit the physical size of a shipment from a factory to a building site. The intermodal shipping container industry has determined that a typical large box size of 8'×8'×40' is amenable to their several modes of transport. The same size limitation will most probably be used for this new frameless building factory subassembly for shipment to a building site, as well.

SUMMARY OF THE INVENTION

The inventive subject matter provides methods and systems in which formed corrugated panels of any material, and exactly matching cyclically variable corner elements are formed by roll forming, for example, by using the roll forming machine and methods described in my U.S. Pat. Nos. 5,337,592, 5,489,463 and 8,573,012. These roll formed sheet material panels and identical matching corner elements are preferably metal although they could be constructed of other materials. The panels and other elements are assembled together at a working site, without the need for a support frame or welded connections, by use of mechanical fastening means to form practically any desired shape or size building, depending on the strength and stiffness of the materials used in the panels and corner elements. The constructed buildings will have TLC at the joints to provide a more secure and stronger building, unavailable with any known method or system, as has been demonstrated by buildings using stacked welded shipping boxes.

An example of a prefabricated steel building without a frame is shown in U.S. Pat. No. 2,742,114 to Behlen. However, Behlen discloses the use of several non-continuous straight angle pieces connecting the flat portions of Behlen, which cannot deliver a total load connection. And there is no way Behlen could be modified by any of the Paulson patents discussed above, without using the teaching of the present invention.

In one aspect of the present invention a frameless building is formed by joining together first and second ends of selected corrugated panels to first and second ends of adjacent corrugated panels by connecting them to a matching repetitive bent corner member by means of at least one mechanical fastening element. The formed sheet material and corner elements are preferably designed and formed from specifically selected metal or other materials to achieve the best desired results for the frameless building being assembled, depending on the selected site. Additionally, once the corrugated subassembly panels are positioned at the building site, continuous high-strength cap members are preferably placed over the corner elements or connectors. The cap member turns the as-yet uncapped corrugated panel assembly into a true built-up deep beam spanning between wall supports, using known structures design methods. Those skilled in the art will appreciate that various corrugated designs can be used consistently with the inventive concepts discussed herein, based on the different materials being used, the site selected and other variables, such as climate and intended use of the finally assembled building. Additionally, it is to be understood that doors, windows and utilities, outside wall closures, decorative features and other desired, needed and/or known elements of buildings are to be added, using available technology and in accordance with local building codes, when finalizing the frameless buildings of the present invention.

Broadly, the present invention includes a method to form frameless buildings having joints with Total Load Connectivity at the joints to improve their strength and allow a myriad of heretofore unavailable designs to be configured for both aesthetic and practical reasons.

Various objects, features, aspects, and advantages of the inventive subject matter will become more apparent from the following detailed description of preferred embodiments, along with the accompanying drawing figures in which like numerals represent like components.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

BRIEF DESCRIPTION OF THE DRAWINGS

FIG. 4 is similar to the building of FIG. 3 with the middle wall elements replaced by sets of beams and columns and the floor and ceiling levels supported by beams; while

DETAILED DESCRIPTION

As shown in drawings, the present invention provides a method and system to construct buildings of substantially any shape and size using corrugated metal panels secured together by cyclically variable edge members such as shown and described in U.S. Pat. Nos. 5,337,592, 5,489,463 and 8,573,012, without the need of a separate frame for the building. The only limit to the shape and size of the buildings would be the imagination of the designer and the strength, shape and thickness of the material(s) used to form the corrugated panels and the cyclically variable corner or edge elements or members.

Figure 1:
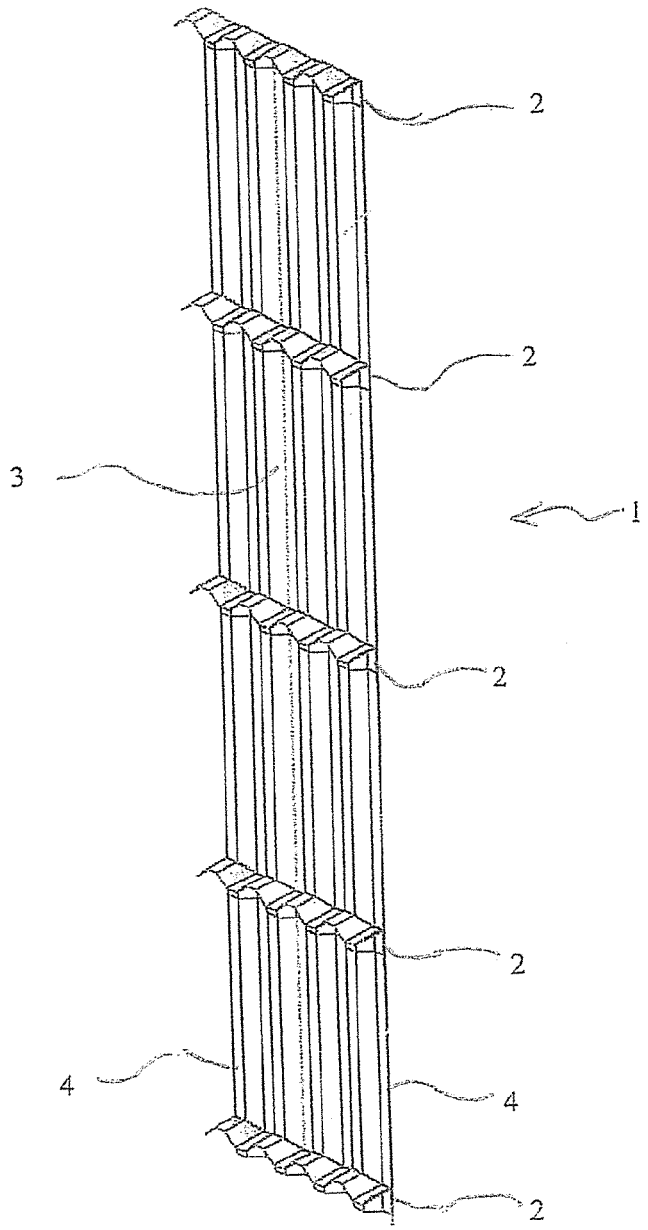
FIG. 1 is a perspective view of a preferred maximum size frameless building component of the present invention, which is factory assembled and capable of being transported, without constraints on shipping, by all known means of transport, separately or in an intermodal shipping container.

Turning now to the figures, FIG. 1 shows a building component 1 that is factory assembled and sized and dimensioned to a maximum size that fits in and is capable of being transported, without any constraints or need for adaptation, separately or in available intermodal shipping containers (maximum size of 8' wide×8' high×40' long), by known means of transport, such as truck, train, container ship or air cargo. This building component 1 includes a plurality of cyclically variable elements 2, secured intermittently to the elongated continuous corrugated panel 3. In some design configurations, back-to-back elements 2 are used where horizontal corrugated panels attach on both sides of the component 1. The vertical edges of the building component 1 may include vertical edge joining elements 4, such as panel-to-panel edge connections and/or edge members such as corner posts.

Figure 2:
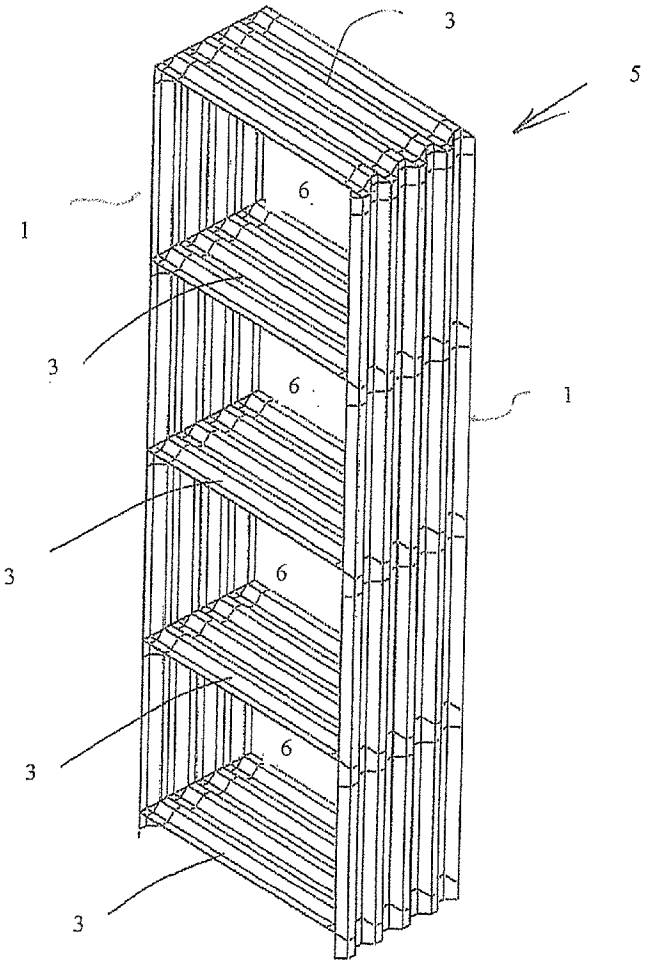
FIG. 2 is a perspective view of a simple four story high building cell constructed at a building site using two components shown in FIG. 1 to assemble a 4 level single-cell building.

FIG. 2 shows a simple 4-story building 5, constructed at a building site by using 2 building components 1 as sides, with a plurality of further corrugated panels 3 secured between cyclically variable elements 2 on the opposite sides to form four levels of usable 8'×12' rooms or spaces 6.

Figure 3:
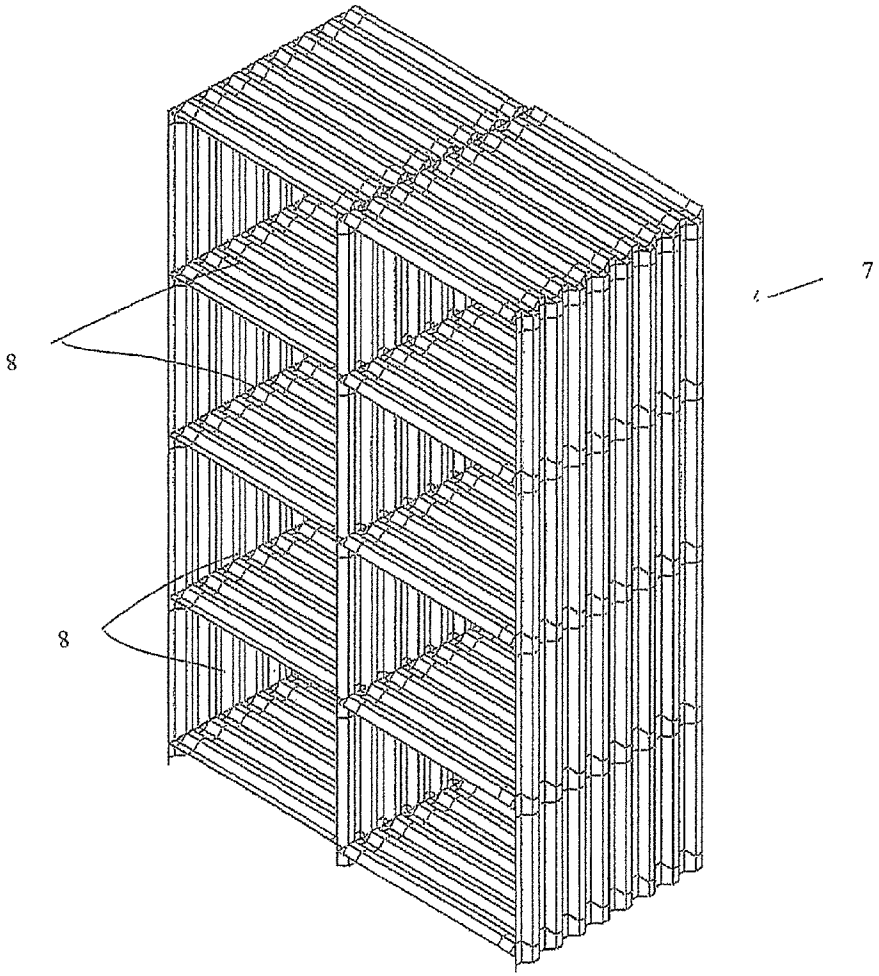
FIG. 3 is a perspective view of four FIG. 2 building cells assembled to create a 4-story building in accordance with the present invention.

FIG. 3 shows a building 7 comprised of four of the FIG. 2 building cells 5 assembled together, side-by-side and end-to-end to create a 4-story building with each floor having two free open spaces 8 that are 12'×16'.

Figure 4A:
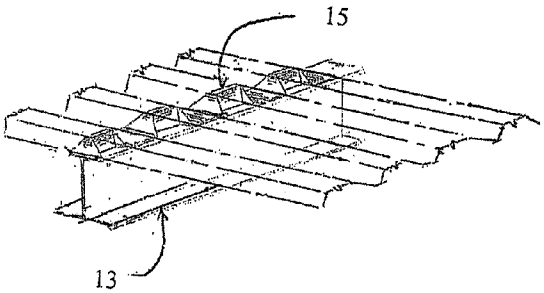
FIG. 4A is an enlarged detail of FIG. 4 taken along line 4A.
Figure 4:
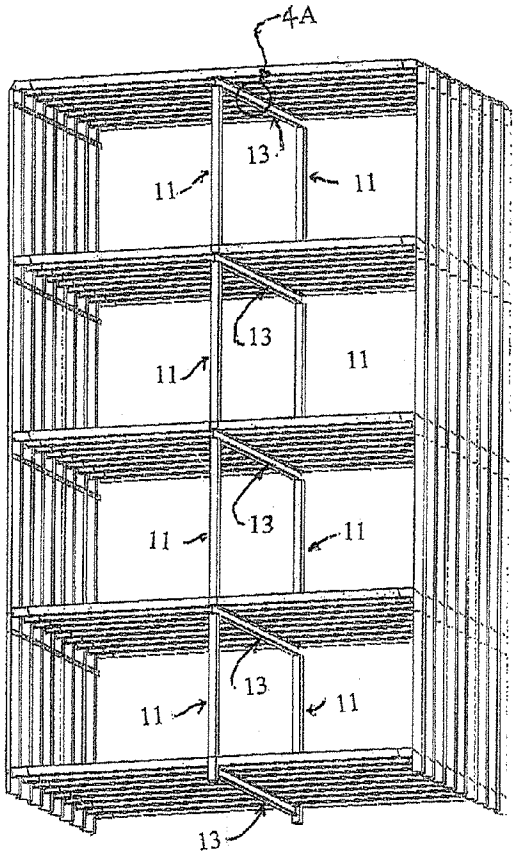

FIG. 4 shows a building 9 that is similar to the building of FIG. 3, however, the middle wall elements have been replaced by sets of beams and columns 11, 13 to provide support to the floor and ceiling levels. This provides an open usable space of 24'×16'. FIG. 4A illustrates the placement of known cyclically variable closure elements 15, such as described in Applicant's prior U.S. Pat. Nos. 5,337,592 and 5,489,463 and shown in FIG. 24 thereof, referred to above in paragraph 0009. These closure elements are placed between the corrugated metal floor and ceiling panels and its support beam and column set to create a Total Load Connection for the vertical shear load transfer between the horizontal corrugated panels and their support beams 13.

Figure 5:
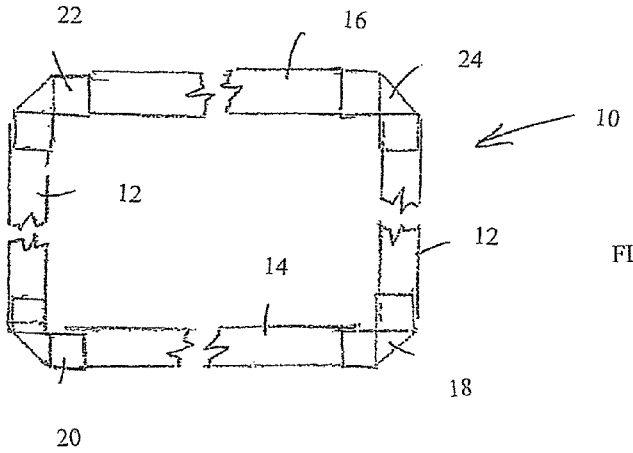
FIG. 5 is an end view of a one-cell or unit building unit formed in accordance with the present invention.

FIG. 5 shows a frameless building having a single cell, room or unit 10 formed from corrugated panels, including two vertical walls 12, a floor deck 14 and a roof deck 16. The walls 12, floor deck 14 and roof deck 16 include first and second ends that are secured together by cyclically variable corner or edge members 18, 20, 22, 24 using mechanical fasteners, such as rivets or bolts, to form joints that have total load connectivity. The dimensions of all of the elements of the building 10 may vary, depending on the specific design, the angle of the corrugated panels, the geometry of the corrugated panels, the desired space height, floor/ceiling spans and the metal used to form the elements.

Figure 6:
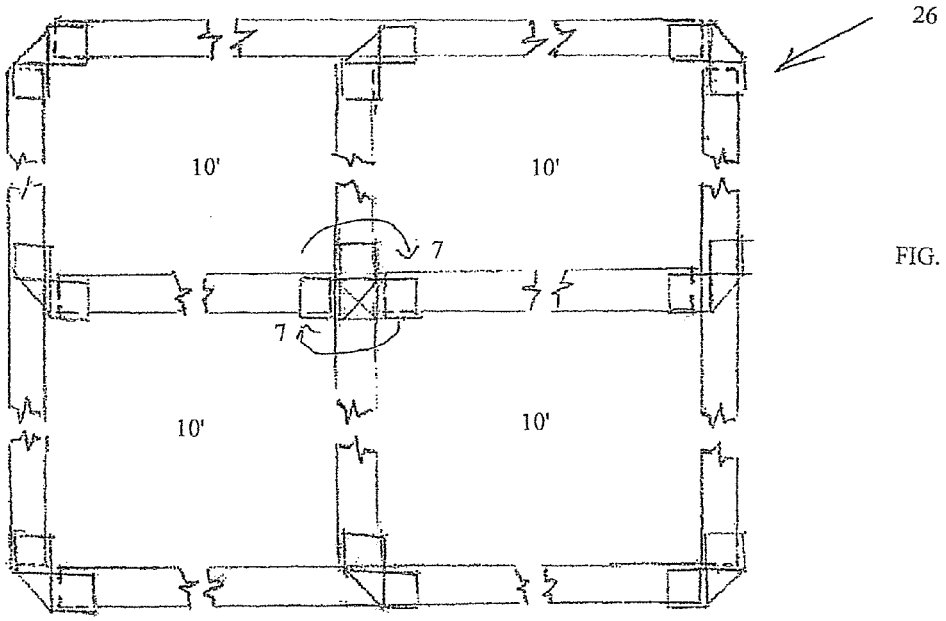
FIG. 6 is an end view of building having multiple rooms or usable spaces, side-by-side and stacked in accordance with the principals of the present invention.

FIG. 6 shows a frameless building 26, similar to FIG. 5, except that it is expanded to create a plurality of cells, rooms, spaces or units 10', placed side-by-side and stacked, to create a simplified multi-story and wide metal building structure without the need of separate support frame or similar structure.

Figure 7:
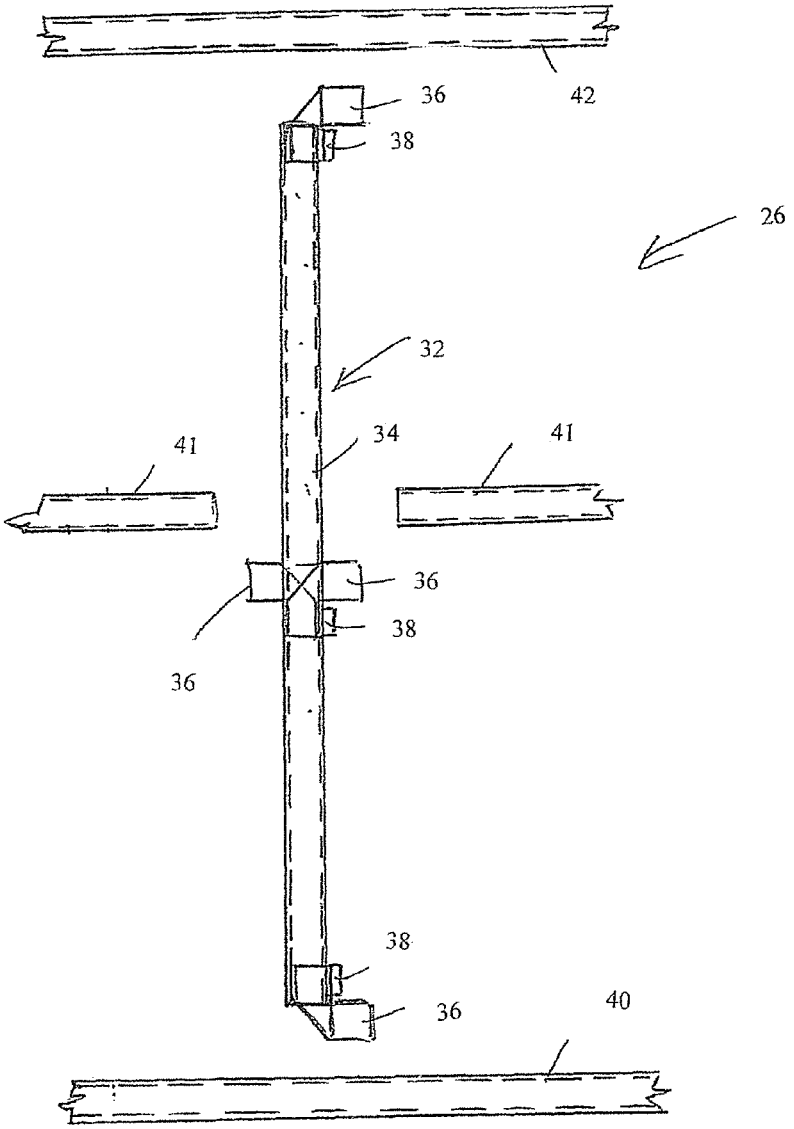
FIG. 7 is a detailed view of a central vertical wall of a 2-story building similar to FIG. 3, showing more detail of the connectivity of factory sub-assembled parts.

FIG. 7 shows in detail how a larger frameless metal building, such as 26 may be constructed using parts that are partly assembled in a factory and others at the building site. For example, a central vertical wall 32 may be assembled in a factory. The wall 32 includes a corrugated wall panel 34 having cyclically variable connectors 36 riveted or otherwise mechanically secured thereto at the ends and centrally along its length to allow flooring to be secured thereto at a building site. Additionally, cap members 38 may be bonded or secured over connectors 36 on the vertical wall assembly 32 to provide the panel bending strength. Floor decks 40, 41 and a further floor or roof deck 42 may be mechanically secured to the cyclically variable connectors 36 of the corrugated wall panel 32 at the building site when erecting a frameless building. The various parts may be separately shipped or packaged and shipped together to the building site.

Figure 8:
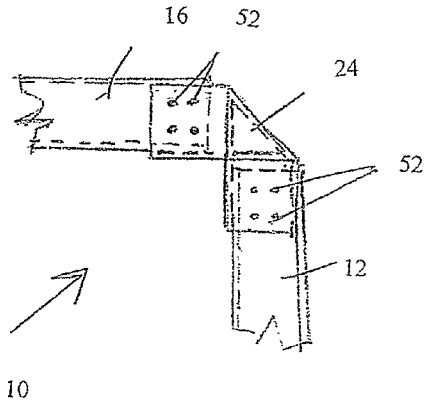
FIG. 8 is an enlarged partial top view of the onsite assembly of factory sub-assembled; parts.

FIG. 8 illustrates an enlarged partial view of an upper corner of FIG. 5, wherein the corner member 24 is secured to the ends of adjoining corrugated panels 12, 14 by means of rivets 52.

Figure 9:
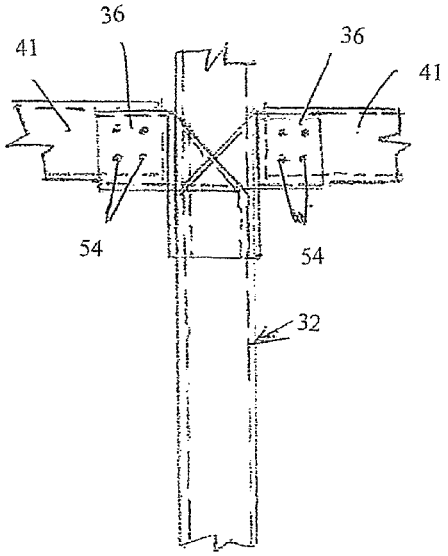
FIG. 9 is an enlarged partial top view of an on-site assembly of factory sub-assembled parts.

FIG. 9 illustrates an enlarged partial view of an interior junction as shown in FIGS. 2 and 4, wherein corner members 36 are secured to vertical panel 32 and the interior ends of two lateral floor decks 41 by rivets 54.

Figure 10:
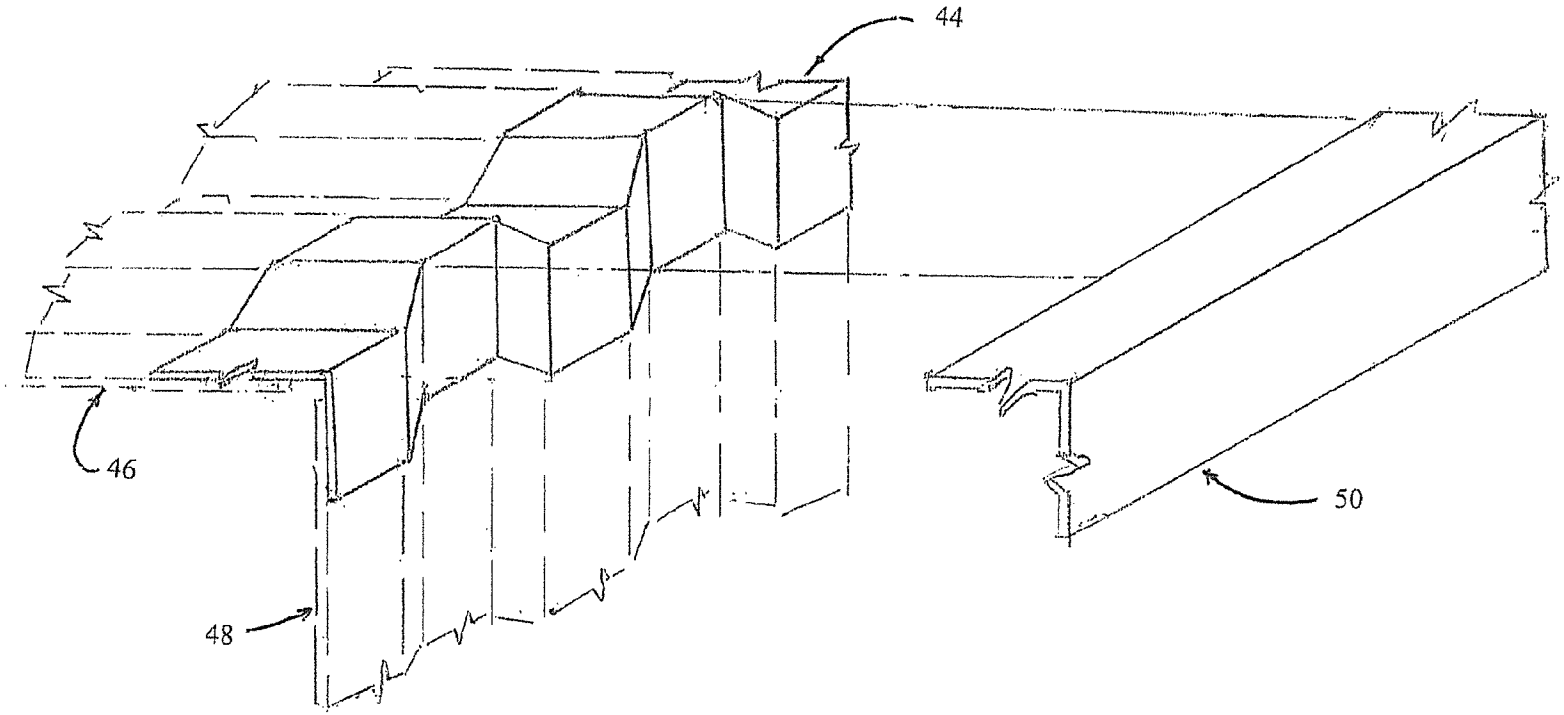
FIG. 10 is an enlarged partial exploded view of a pair of assembled corrugated panels joined by a cyclically variable corner element, with a linear element used as a beam cap element to provide bending strength and rigidity to the corrugated panel spanning between support points at the foundation corners of the building.

FIG. 10 shows an enlarged partial exploded view of a completed corrugated connector member joint having a cyclically variable corner member 44 mechanically securing two corrugated panels 46, 48 together, with a cap member 50 in position to cover and add strength to the joint when secured over the corner member.

FIGS. 1-4A show how a building designer can easily create any shape, size and style of useful low-rise frameless corrugated metal building through choosing combinations of described component elements. Once a configuration is chosen for a particular building project the final details of foundation design and interfaces can be identified. The major vertical load transfer points to the site's foundation are now identified. Attach fittings connect the building load transfer members to corresponding support points in the foundation. Commonly, such points are at corners where panels meet, and at other columns or posts included in the design. Other known methods of foundations also could be used to provide secure connections of frameless metal or other material buildings to the ground, as well.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A method of assembling a frameless building from roll formed corrugated sheet material comprising the steps of:

forming a plurality of specifically shaped and sized corrugated panels having first and second ends;

forming cyclically repetitive bent corner members that exactly match the shape of the specifically shaped and sized corrugated panels; and joining the first and second ends of selected corrugated panels to first and second ends of adjacent corrugated panels by a matching repetitive bent corner member by means of mechanical fasteners to connect adjoining similar corrugated panels to form joints with an engineered joint design that will transfer all six load types, namely, $F_x$, $F_y$, $F_z$, $M_x$, $M_y$ and $M_z$ across the formed joints.

2. The method of assembling a frameless building of claim 1, further including the step of adding a high strength cap member over the formed joints.

3. The method of claim 2, further including the step of forming a box structure having a plurality of joints formed by mechanically fastened together corrugated panels.

4. The method of claim 3 wherein the mechanical fasteners are designed by engineering analysis and selected from the group of rivets, bolts, staples, bonding or combination thereof.

5. The method of claim 1, further including the step of partially forming sub-assemblies of at least one corrugated panel and matching repetitive bent corner member for shipment to a building site for assembly with other corrugated panels.

6. The method of claim 1 wherein the fastened together panels and repetitive bent corner members may be at substantially any angle to each other so as to form differently shaped and sized buildings.

7. A method of assembling a low-rise frameless metal building from high strength roll formed corrugated metal sheet material comprising the steps of:

forming a plurality of specifically shaped and sized high strength metal corrugated panels having first and second ends;

forming high strength cyclically repetitive bent metal corner members that exactly match the shape of the specifically shaped and sized metal corrugated panels; and joining the first and second ends of selected metal corrugated panels to first and second ends of adjacent metal corrugated panels by a matching repetitive bent metal corner member by means of mechanical fasteners to connect adjoining similar corrugated panels to form joints with an engineered joint design to create a total load connection that will transfer all six load types, namely, $F_x$, $F_y$, $F_z$, $M_x$, $M_y$ and $M_z$ across the formed joints.

8. The method of assembling a low-rise frameless metal building of claim 7, further including the step of adding a metal linear cap member over the formed joints to provide bending strength to the corrugated panel assembly.

9. The method of claim 8, further including the step of forming a metal box structure having a plurality of joints formed by mechanically fastened together corrugated panels.

10. The method of claim 9 wherein the mechanical fasteners are selected from the group of rivets, bolts, staples, bonding or combination thereof.

11. The method of claim 7, further including the step of forming a high strength metal sub-assembly comprised of at least one metal corrugated panel secured together with at least one matching high strength metal repetitive bent corner member for shipment to a building site for assembly with other similar metal sub-assemblies to form a low-rise frameless metal building.

12. The method of claim 7, wherein the fastened together panels and repetitive bent corner members may be at substantially any angle to each other so as to form differently shaped and sized low-rise frameless metal building.

13. A method of forming a low-rise frameless building having joints with Total Load Connectivity at the joints comprising the steps of:

forming a plurality of specifically shaped and sized high strength metal corrugated panels having first and second ends;

forming cyclically repetitive, high strength metal, bent corner members that exactly match the shape of the specifically shaped and sized metal corrugated panels; and joining ends of selected specifically shaped and sized corrugated panels to adjacent ends of other selected specifically shaped and sized corrugated panels to matching repetitive, high strength metal, bent corner members by means of a non-welded connecting means to form building subassemblies having mechanical fasteners connecting adjoining similar corrugated panels to form joints with an engineered joint design that will transfer all six load types, namely, $F_x$, $F_y$, $F_z$, $M_x$, $M_y$ and $M_z$ across the formed joints in the subassemblies and any final on-site assembly.

14. The method of claim 13, wherein the specifically shaped and sized corrugated panels and the cyclically repetitive bent corner members are made from high-strength sheet metal.

15. The method of claim 14 wherein the non-welded connecting means are mechanical fasteners that may be applied at a factory or at a building site.

16. The method of claim 13 wherein the building subassemblies are sized and dimensioned so as to be readily transportable to a building site using available transportation means.

17. The method of claim 16 wherein the building subassemblies are sized and dimensioned so as to fit into a box shaped cargo envelope that is 8' wide ×8' tall and 40' long.

* * * * *